US005540441A

United States Patent [19]

Ilan et al.

[11] Patent Number: 5,540,441

[45] Date of Patent: Jul. 30, 1996

[54] LOTTERY PAYOFF METHOD HAVING PYRAMID SCHEME

[76] Inventors: Aviv Ilan; David Ilan, both of 6343 Bluebell Ave., N. Hollywood, Calif. 91606

[21] Appl. No.: 516,525

[22] Filed: Aug. 18, 1995

[51] Int. Cl.[6] ..... A63F 3/08

[52] U.S. Cl. ..... 273/269; 273/139; 273/274

[58] Field of Search ..... 273/269, 274, 273/138 R, 139, 292, 144 R, 144 A, 144 B, 138 A, 153 P; 283/903

[56] References Cited

U.S. PATENT DOCUMENTS

| | | | |
|---|---|---|---|
| 4,034,987 | 7/1977 | Kelly | 273/139 |
| 4,711,453 | 12/1987 | Saint Ive . | |
| 4,842,282 | 6/1989 | Sciarra . | |
| 5,116,049 | 5/1992 | Sludikoff et al. . | |
| 5,158,293 | 10/1992 | Mullins . | |
| 5,324,035 | 6/1994 | Morris et al. | 273/139 |
| 5,407,200 | 4/1995 | Zalabak . | |

*Primary Examiner*—Vincent Millin
*Assistant Examiner*—William M. Pierce
*Attorney, Agent, or Firm*—Richard C. Litman

[57] ABSTRACT

A pyramid game randomly assigns integers to players of the game, and arranges the player positions corresponding to those integers in a pyramidal hierarchy having a geometric progression of the powers of two, from a single number at the apex to multiple numbers in a base row. Provision is made for redistribution of player positions forming only a fraction of a row, proportionally to other rows to ensure that the base row or level contains no more than half of the total player positions. The integers of the player positions are arranged in numerical order, with the highest number at the apex and other numbers distributed to the remaining player positions in descending order. Alternatively, an apex number may be randomly selected, with the remaining lower numbers positioned in descending order therebelow and any higher numbers positioned following the lower numbers. Numbers corresponding to the lowermost row or level in the pyramidal hierarchy receive no payoff, with numbers in higher levels receiving increasing amounts; all positions in a given level receive equal amounts. Thus, a player knowing the high and low limiting numbers of the game and who randomly receives a number in the set, will quickly have at least some idea of a possible payoff according to the relative position of his/her number in the set. The present game is adaptable to large numbers of players in a lottery system, and may be played electronically and/or using printed lottery tickets or the like.

20 Claims, 4 Drawing Sheets

LOTTERY PAYOFF METHOD HAVING PYRAMID SCHEME

FIELD OF THE INVENTION

The present invention relates generally to wagering type lottery games in which players are randomly assigned numbers and/or a winning number is randomly selected, and more specifically to such a game in which numbers are randomly assigned to the players, with the numbers then being placed in a pyramidal hierarchy according to their numerical order. Payoffs are provided according to the level of the pyramidal hierarchy in which a given number is placed.

BACKGROUND OF THE INVENTION

Games of various sorts, and particularly wagering and betting games, have been a popular pastime for people since the beginning of recorded history. More recently, gambling has become an organized activity, with casinos and various games being developed in various locations where such activities are legal. Even more recently, numerous state governments have seen that such wagering games may be used as a form of "voluntary taxation," in which players pay money to the state in return for some chance of winning a larger return.

Generally, such games award the overwhelming majority of the payoff to a single individual, and rely upon a drawing or the like to determine a single winning number. While further drawings may be made for secondary or lower payoffs, each payoff is randomly determined, rather than being predetermined according to any numerical ranking of the numbers provided to the players.

Also, generally players are allowed to choose a specific number(s) for such games, rather than being provided a random number(s) for play of the game. While such may seem advantageous to some less knowledgeable players who have a "favorite number" or "system" which requires the selection of a certain number(s), a truly random drawing will randomize any results to the point that the selection of specific numbers will make no difference. Such random drawings, in which a perhaps considerable delay occurs between the time of a lottery ticket purchase and the determination of the winning number(s), is not effective in reinforcing the participation of players.

On the other hand, provision of random numbers to the players initially, offers the advantage of a game in which the winning number(s) is/are preselected, according to numerical or some other order. Thus, a player who understands the hierarchy of the numbers, will know instantly whether he/she has a winning number, or at least a good chance of winning, as soon as the number is issued to the player.

Accordingly, a need will be seen for such a lottery game in which numbers are randomly provided to players, but in which the winning numbers are predetermined at least to some extent, in accordance with numerical or some other order. Additional payoffs to more than a single player may be provided, in accordance with a pyramidal structure for the arrangement of the numbers used in the game. Payoffs of different amounts may be provided, according to the rank or level of the numbers in the pyramid structure, thus enabling a player to have at least some idea whether his/her number may be a winner, immediately upon receiving that number. Alternatively, the numerical hierarchy may be randomized if desired.

DESCRIPTION OF THE PRIOR ART

U.S. Pat. No. 4,711,453 issued to Michael H. Saint Ive on Dec. 8, 1987 describes a Dice Pyramid Tally Board And Game in which all possible numerical combinations of a pair of six sided dice are provided on a triangular board. The numbers are fixed and do not change, but are merely used as locations to mark the result of the toss of two die. The present pyramid game invention utilizes a triangular configuration only for the determination of the numerical hierarchy of the numbers randomly assigned to the players, which numbers may change from game to game as they may form only a fraction of the set of integers between the high and low numbers of the game. Moreover the present game provides a payout according to the rank or level of winning numbers in the pyramidal hierarchy. Saint Ive is silent on the matter of payouts, either multilevel or otherwise.

U.S. Pat. No. 4,842,282 issued to Michael Sciarra on Jun. 27, 1989 describes a Method For Playing A Triangular Pyramid Board Game, in which a rectangular board is used with the starting and ending playing piece formations being generally triangular. The present pyramid game does not use a playing board, and the numbers do not represent playing pieces. Moreover, the specific numbers arranged in the triangular or pyramidal configuration according to the present invention, may vary from game to game, whereas the numbers on the game board and of the playing pieces are fixed and unchanging in the Sciarra game. Sciarra makes no mention of any form of monetary payoff, or of any different levels of winning according to the rank or level of the playing pieces on the board, as provided by the rank or level of the numbers of the present pyramid game.

U.S. Pat. No. 5,116,049 issued to Stanley R. Sludikoff et al. on May 26, 1992 describes a Lottery Game System And Method Of Playing, comprising a ticket having a plurality of multiple digit numbers forming ranks and files thereon. Players may preselect the numbers they desire, but the winning numbers which must be matched are randomly drawn, which procedure is essentially the opposite of that used in the present game. Moreover, the numbers used are not assembled in numerical order on the ticket, and while lower payoff amounts may be provided for matching fewer numbers, the Sludikoff et al. game does not arrange those payoffs according to the rank or level of the winning numbers on a triangular or pyramidal configuration, as does the present game.

U.S. Pat. No. 5,158,293 issued to Wayne L. Mullins on Oct. 27, 1992 describes a Lottery Game And Method For Playing Game, wherein a single lottery ticket provides for the instant determination of a win or loss, as well as providing the holder with a potential future jackpot win or wins. The present game is primarily directed to an "instant" type of game, in which a player may readily determine whether he/she at least has a chance at some payoff. However, due to the nature of the present game, such payoff may not be assured, particularly for numbers near the midrange of possible numbers, thus adding an element of longer term chance to the game. In any event, Mullins does not provide for different levels of payoffs depending upon the rank or level of a number in a triangular or pyramidal hierarchy wherein all possible numbers are arranged in numerical order, as provided by the present pyramid game.

Finally, U.S. Pat. No. 5,407,200 issued to James M. Zalabak on Apr. 18, 1995 describes a Lottery-Type Gaming System Having Multiple Playing Levels, with payoffs arranged in a vertical hierarchy on a triangular format. However, Zalabak provides payoffs to at least some numbers of the bottom row of his triangular configuration, whereas no payoffs are provided to the lowermost row according to the present game. Zalabak also provides such payoffs randomly to only a fraction of the numbers of any one row, whereas in the present game provides equal payoffs to all numbers appearing in a given row or at a given level of the pyramidal hierarchy. Moreover, the game numbers or symbols are randomly developed on both the individual player tickets and also on the master game card, which determines the correspondence of the numbers held by players to the winning numbers. In the present game, all numbers used in the course of the game are arranged in a predetermined numerical order in a pyramidal configuration.

None of the above noted patents, taken either singly or in combination, are seen to disclose the specific arrangement of concepts disclosed by the present invention.

SUMMARY OF THE INVENTION

By the present invention, an improved pyramid game is disclosed.

Accordingly, one of the objects of the present invention is to provide an improved pyramid game which is adaptable to a lottery type gambling or wagering game.

Another of the objects of the present invention is to provide an improved pyramid game which provides for the random issuance of numbers to players, but which arranges those numbers in a predetermined pyramidal hierarchy.

Yet another of the objects of the present invention is to provide an improved pyramid game in which the payoff increases for numbers having a higher position or level in the pyramidal hierarchy, with all numbers in the same level or row providing an equal payoff.

Still another of the objects of the present invention is to provide an improved pyramid game which number of pyramidal levels is determined according to a geometric progression of exponential powers of two, with the apex comprising a single number position or two to the zero power, the second row comprising two positions or two to the first power, the third row comprising four positions or two to the second power, etc. as required.

A further object of the present invention is to provide an improved pyramid game in which additional positions comprising only a partial row of numbers, are distributed among other rows generally proportionally to the number of positions in each row.

An additional object of the present invention is to provide an improved pyramid game in which the numbers represented comprise at least a fraction of a set of integers limited by a highest number and a lowest number, with the highest number being positioned at the apex of the pyramid and providing the greatest payoff and the lowest number being positioned in the bottom row and the bottom row numbers providing no payoff.

Another object of the present invention is to provide an improved pyramid game which in an alternate embodiment randomly selects a number from the set for the apex number, with the remaining lower numbers being arranged in descending order therebelow and any higher numbers being positioned below the lower numbers in the pyramidal hierarchy.

Yet another object of the present invention is to provide an improved pyramid game which is adaptable to electronic play, as well as to the use of hard copy tickets and the like.

A final object of the present invention is to provide an improved pyramid game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
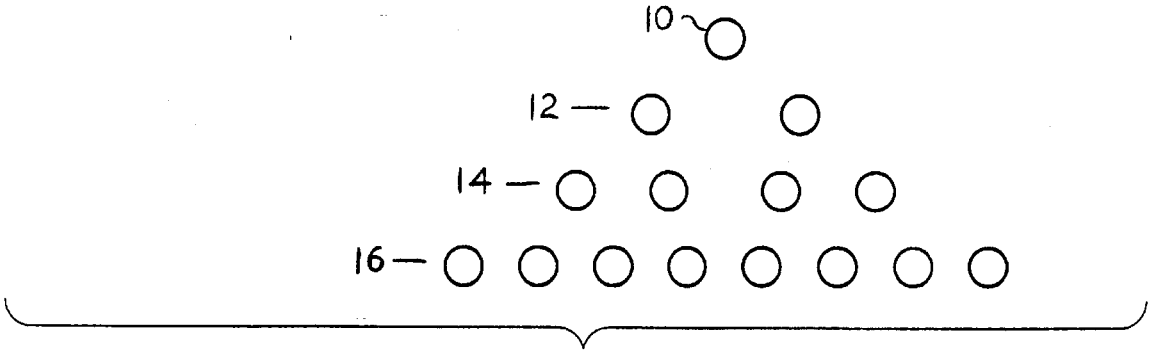
FIG. 1 is a simplified schematic representation of a pyramidal hierarchy of player positions for the present pyramid game, showing the geometric progression of the number of positions in each row or level.

Referring now to the drawings, the present invention will be seen to relate to a pyramid game in which the number of player positions is arranged in a pyramidal hierarchy, with a single apex or peak position and increasingly greater numbers of positions in the levels or rows below the peak or apex position. The pyramid configuration for each game is developed in accordance with the number of players for that game, with the pyramid configuration varying from game to game as different numbers of players play each game. Each player is randomly assigned an integer from a finite set of integers, and those randomly assigned numbers are placed in the player positions of the pyramid, in numerical order. Awards, prizes, or payoffs may be provided to the numerical rankings of the players in accordance with their corresponding positions in the pyramid, with the player having the number corresponding to the apex or peak position receiving the greatest award, players in the penultimate level receiving the next greatest award, etc., through the second row or level from the bottom; no payoff or award is provided for players having numbers assigned to the base level.

FIG. 1 provides a schematic view of a simplified exemplary pyramidal configuration of positions, as may be used for a game according to the present invention and involving 15 players. Preferably, the pyramidal configuration is arranged in a geometric progression using increasing exponential powers of two. Thus, each level or row will have exactly twice the positions of the next higher level. The apex or peak level has a number of positions defined by two to the zero power, or a single position 10. The second level 12 has a number of positions equal to two to the first power, or two positions. The third level 14 has two to the second power positions, or four positions. The fourth level or row 16 of FIG. 1 is formed of a number of positions equal to two to the third power, or eight positions. Thus, it will be seen that each lower row or level contains exactly twice the number of player positions as the row or level immediately above, with the bottom or base row of the basic pyramid configuration having exactly one more position than the total number of positions in all levels or rows above.

The above example of FIG. 1 is a simplified example of the present pyramid arrangement of player positions, and it is envisioned that in lottery situations, that perhaps thousands or tens of thousands of players may be playing in a single game, by electronic means. It will be seen that the number of rows or levels may be increased as required, depending upon the number of players involved in any given game. For example, a pyramid having twelve rows or levels would contain a total number of player positions equal to two to the eleventh power, plus two to the tenth power, plus two to the ninth power, etc., to the single apex position of two to the zero power. The above twelve levels would provide a total of 8191 player positions. The precise number of positions in any such basic pyramidal structure may be easily determined, as it will always be one less than two raised to an exponential power of one greater than the number of rows or levels of the pyramidal structure. In the above example of a pyramid having twelve levels, two raised to the thirteenth power would equal 8192. 8192 minus 1, is equal to 8191, or the total player positions in a pyramid having twelve levels. Other totals of player positions for other pyramids having different numbers of levels, may be readily determined using the above rule.

Figure 2A:
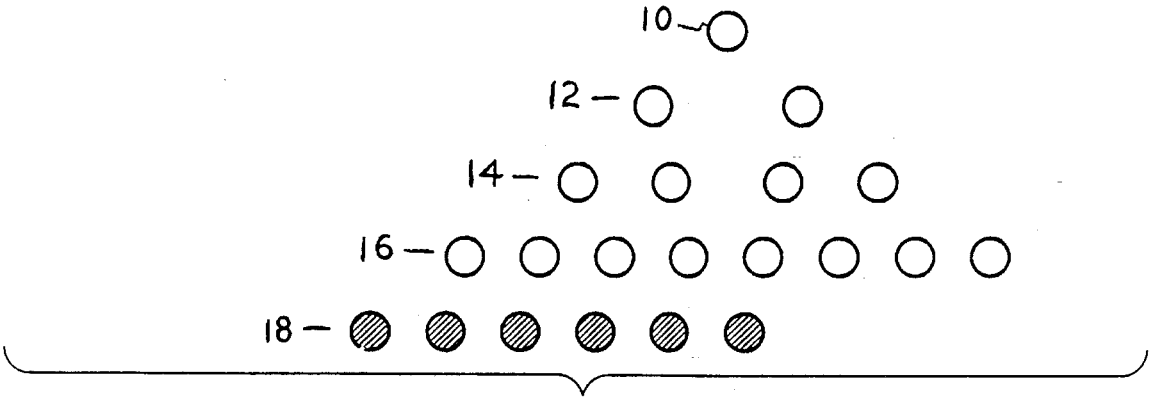
FIG. 2A is a schematic representation of a pyramid format similar to FIG. 1, but including a plurality of additional positions representing a partial additional row or level.
Figure 2B:
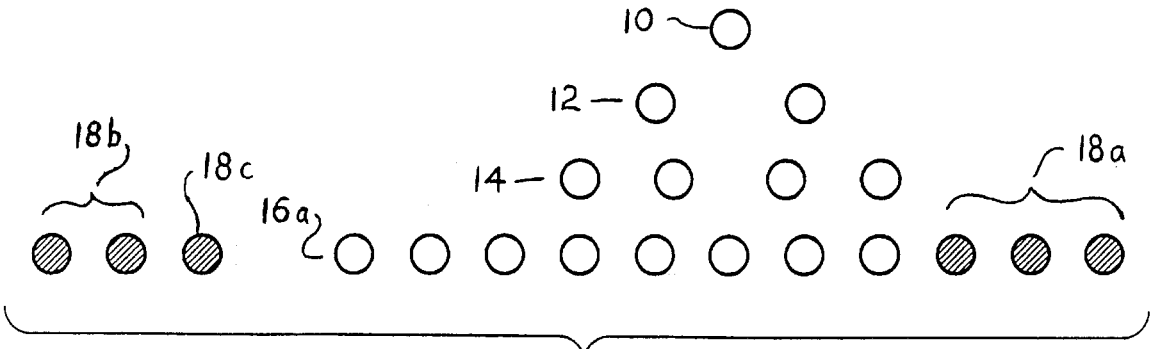
FIG. 2B is a schematic representation similar to FIG. 2A, showing the proportional redistribution of additional positions to the base row or level of the pyramid.

It will be seen that the specific number of player positions provided by exactly doubling the number of positions for each row or level, will seldom exactly accommodate the number of players taking part in any given game. Accordingly, FIGS. 2A through 2E show how other numbers of players may be accommodated in a game. In the example of FIG. 2A, the basic pyramid configuration of FIG. 1 with four rows or levels 10 through 16, or a total of fifteen player positions, is indicated by the open player positions. However, an additional six players wish to join the game, represented by the six shaded player positions of the group 18. (This group does NOT comprise an additional row or level of the pyramid configuration, as it does not contain a sufficient number of player positions to fill completely a subsequent level beneath the base level 16 containing eight player positions, which would require a total of sixteen positions.)

Figure 2C:
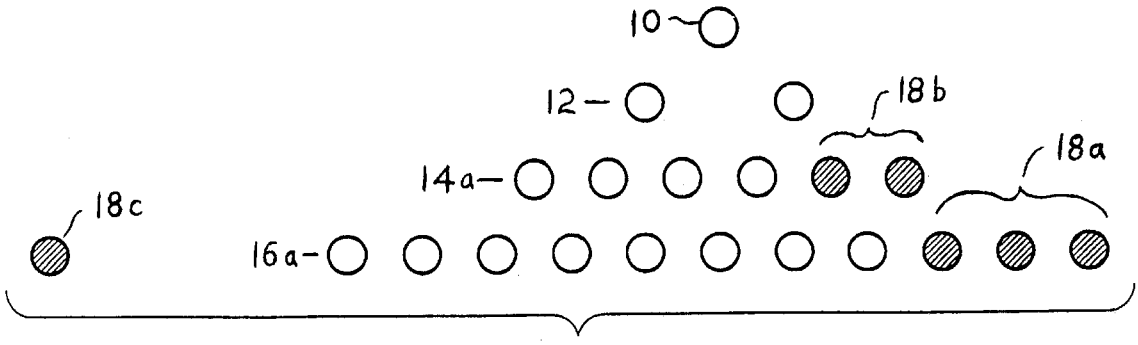
FIG. 2C is a schematic representation based upon FIG. 2B, wherein additional positions are redistributed proportionally to the second row or level.
Figure 2D:
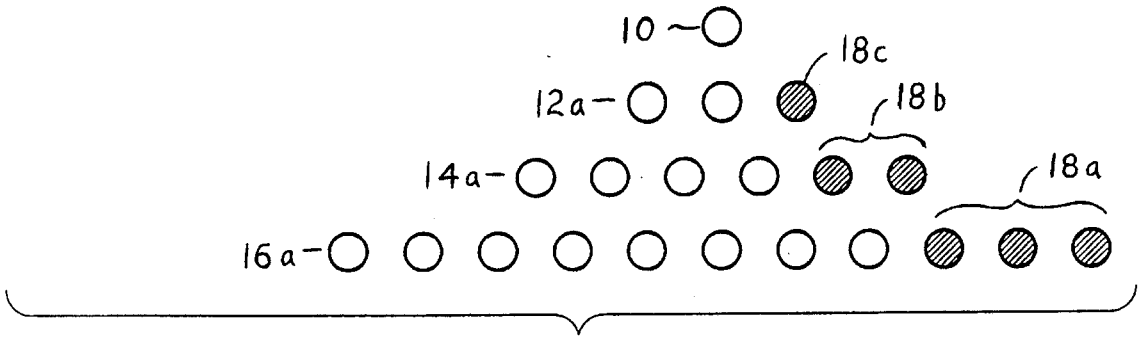
FIG. 2D is a schematic representation based upon FIG. 2C, wherein the remaining positions of the partial row are proportionally redistributed to a higher row.
Figure 2E:
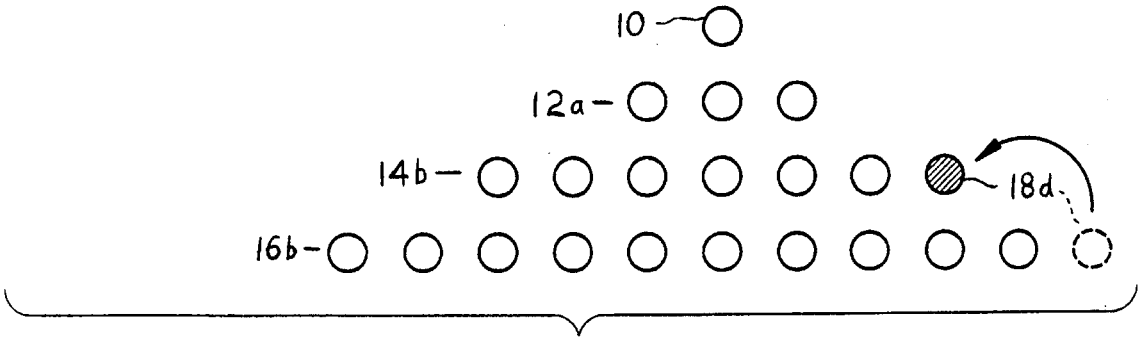
FIG. 2E is a schematic representation based upon FIG. 2D, wherein a final redistribution is accomplished to assure that the bottom row contains no more than one half of all player positions in the pyramidal hierarchy.

Accordingly, these additional player positions are redistributed, as indicated in FIGS. 2B through 2E. The basic rule is that half of the additional player positions are added to the base level, as indicated by the group of shaded player positions 18*a* added to the right of the lowermost level 16*a* in FIG. 2B. The remaining player positions are divided further (as close to half as is possible), as indicated by the group 18*b* and 18*c* of FIG. 2A. The resulting next largest remaining group (i.e., 18B) is redistributed to the row 14*a* immediately above the modified base level or row 16*a*, as indicated in FIG. 2C. The remaining group 18*c* (in this case, only a single player position) is redistributed to the next level up (i.e., level 12*a*), as indicated in FIG. 2D.

The above described redistribution of additional player spaces will be seen to provide accommodation for a number of players not precisely equal to the classic pyramid configuration defined by a geometric progression of exponential powers of two, as shown in FIG. 1. However, it will be seen that with a number of additional player positions which is nearly double the number of positions in the lowermost level of the pyramid, that the lowermost level may end up with somewhat more than half of the total number of positions. Ideally, the lowest level will have very close to one half of the total number of positions, and will not exceed one half the total by more than a single position, as defined by the classic configuration described further above.

Accordingly, it may be necessary to make a secondary redistribution of one or more of the additional player positions of the base level. This is indicated by the movement of a single position 18*d* from the lowermost level 16*b*, to the level 14*b* immediately above in FIG. 2E. This results in half or less of the total positions residing in the lowermost level 16*b*. This is desirable from the point of award or payoff distribution, where such is provided, in order to provide a chance of winning at least a small award which is at least very close to fifty percent, in the present game.

Figure 3A:
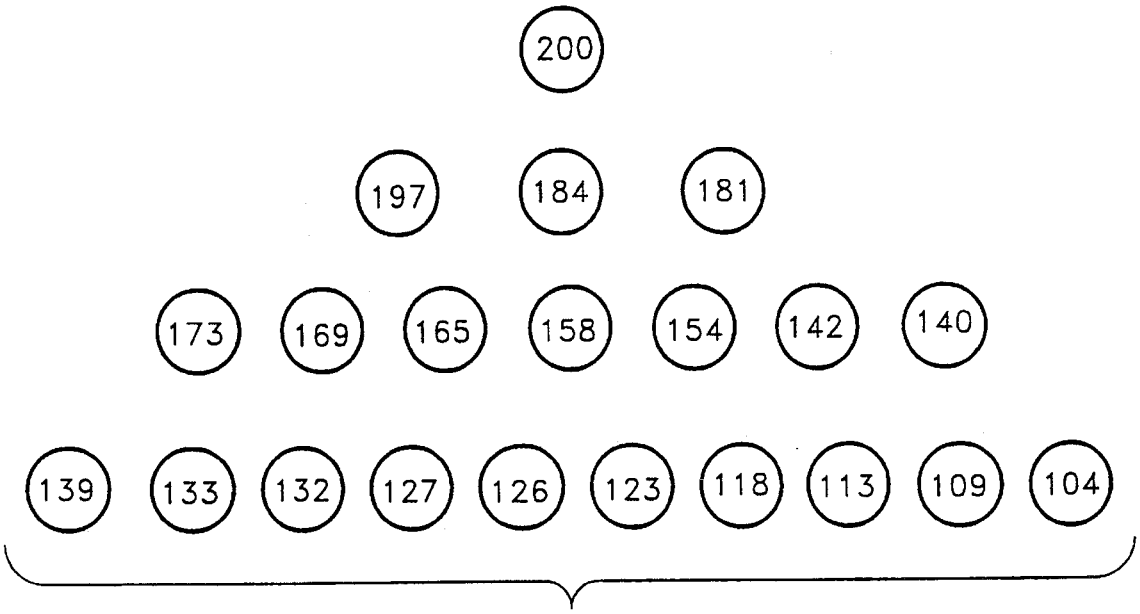
FIG. 3A is a schematic representation of a first embodiment of numerical distribution of an exemplary set of integers used in the play of the present pyramid game, wherein the highest number is positioned at the apex of the pyramid and the remaining numbers are positioned therebelow, in descending numerical order.
Figure 3B:
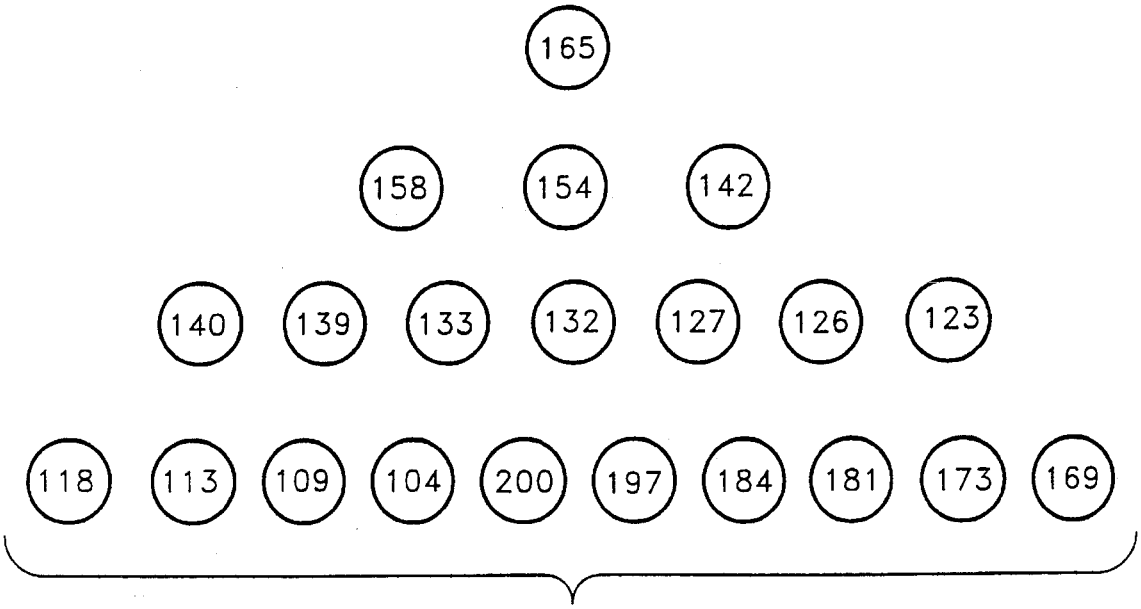
FIG. 3B is a schematic representation of an alternate embodiment of numerical distribution, wherein a number is randomly selected as an apex number, with remaining lower numbers being positioned in descending order therebelow and numbers higher than the apex number being positioned in descending order below the lowest number.

It will be noted that thus far there has been no assignment of specific player numbers to the player positions provided, and that the discussion thus far has been directed only to the provision of a sufficient number of player positions to accommodate all players who wish to enter a given game. FIGS. 3A and 3B show alternate means of distributing the numbers assigned to the players, in the player positions of the pyramidal configuration.

Once the number of players for a game has been determined and the pyramidal configuration established for that number of players in that game, a set of integers at least as large as the number of players (and corresponding number of player positions in the pyramid) is provided. In the examples of FIGS. 3A and 3B, the set of integers ranging from 101 through 200, inclusive, has been provided for the twenty one player positions shown. Each player is randomly assigned an integer from the predetermined set, with no order or preference being provided. Each player receives strictly a random number from the set, regardless of the order in which the players enter the game. No integers are repeated; each player has a distinct assigned integer (or integers; players may enter more than one player position, if desired).

The integers randomly assigned to the players are distributed with the highest number (e.g., the number 200 in FIG. 3A) being placed in the single apex or peak player position of the pyramid. The remaining numbers are placed in descending order from left to right across the remaining levels of the pyramid, to form a pyramidal hierarchy of numbers from top to bottom of the pyramid, in descending numerical order. Thus, the next highest randomly assigned player number 197, is placed in the leftmost position of the second level, the next number 184 is placed immediately to the right thereof, the next number 181 is placed in the far right hand position of the second level to complete that level, the next number 173 is placed in the far left end of the third level, etc. until all player positions in all levels are filled. (It will be understood that the above integers, and those shown in FIGS. 3A and 3B, are exemplary, and that any appropriate set of integers may be used in the present game, as desired.)

The present game will be seen to lend itself well to a lottery type gambling or wagering game, in which each of the players purchases one or more of the random integers used to fill the player positions of the pyramid. At least some percentage of the money received may then be used for awards, prizes, or payoffs to winning players. Preferably, awards are provided based upon the ranking of the levels of the pyramidal hierarchy, with all player positions of a given level receiving identically valued awards or payoffs. The single player position (i.e., the highest number of the set which was assigned for the game) of the apex or peak position (200, for FIG. 3A) receives the largest prize or award, with those numbers in the second level (i.e., 197, 184, and 181) each receiving identical second place awards, players in the third level (numbers 173, 169, 165, 158, 154, 142, and 140) receiving somewhat smaller awards than those provided for the second level players. Again, each of the player positions in a given level receives equal awards or payoffs; thus both the number 173 of the leftmost position in the third level, and the number 140 of the rightmost position in the third level, will receive equal awards in the game of FIG. 3A.

In any lottery type game, there will of course be at least a large percentage of losing players. This is provided automatically in the present game, by withholding any awards or prizes to players in the single base level or row. In accordance with the classical or modified geometric progression used to form a pyramid of the present game, the lowermost level will contain essentially half of the player positions (and randomly assigned player numbers) of those playing. Thus, the elimination of all player numbers in the base row automatically eliminates substantially half of the players.

This pyramidal hierarchy provides a player with at least some idea of whether he/she has won anything, immediately upon being assigned a number, assuming that player is at least somewhat aware of the total number of player positions in the pyramidal hierarchy and the lapper and lower limits for the set of integers used for that game. Thus, a player of the game of FIG. 3A who draws the number 154 of the set from 101 to 200 will know that he/she will likely be very close to the end of the third level or to the beginning of the lowermost level. That player knows that he/she has some chance of winning a smaller prize or payoff, and may not win anything, if the number by chance falls into the base level.

On the other hand, a player drawing the number 197 in the above game, would know immediately even without seeing the pyramidal hierarchy, that he/she would have won at least a second level prize, even assuming that all numbers from 200 to 197 had been drawn, and that he/she might have won the top prize, as only three other numbers of the set remain above the number 197, and those numbers may or may not have been randomly assigned in any specific game. In this example, the number 197 is the second highest number assigned, and accordingly is placed in the leftmost position of the second row or level, with the player holding that number 197 being awarded a second level prize or payoff.

Obviously, a player who is randomly assigned the highest number in the set, is assured of receiving the apex position and the greatest prize or payoff. However, as the number of players (and corresponding player positions in the pyramidal hierarchy) may be only a fraction of the number of integers comprising the number set used, there is no assurance that the highest number in the set will be issued.

In order to add further uncertainty to the game, if desired, an alternate hierarchy may be used, as shown in FIG. 3B. In the case of FIG. 3B, a number from those randomly assigned to the players (e.g., 165), was randomly selected as the apex or peak number. All lower numbers of the set are then distributed in descending numerical order as described for FIG. 3A, with the next three lowest numbers 158, 154, and 152 being assigned from eft to right in the second level, the next seven lowest numbers 140, 139, 133, 132, 127, 126, and 123 being assigned from left to right in the third level, etc. When the lowest number which has been assigned to a player is reached, the remaining player positions are filled with the remaining highest assigned numbers of the set, again in descending order. Thus, the number 200 is assigned the fifth position of the base level, with the numbers 197, 184, 181, 173, and 169 filling the remainder of the base level to the right of the number 200. As in the example of FIG. 3A, those players having numbers in the lowermost row receive no prizes; only those players having numbers in levels above the base level receive awards or payoffs.

The above arrangement can add considerable suspense to the present game, as even if a player knows his/her relative position in the set of numbers used for the game, the use of a random number from the set for the apex number, eliminates any possibility of making even an educated guess as to any possible payoff, until the final configuration of the pyramidal hierarchy is made known. It will be seen that between FIGS. 3A and 3B, the holder of the highest number in the set from 101 to 200, will have gone from the top prize to no prize at all, due to the randomizing of the apex number in the pyramid game of FIG. 3B.

As noted above, the present game in its various embodiments ends itself well to a lottery type game, wherein players pay for one or more randomly assigned numbers and receive prizes or payoffs depending upon the position of their number(s) in the pyramidal hierarchy. It will be noted that the hierarchies of FIGS. 3A and 3B are but two possibilities for the orderly distribution of the player numbers randomly assigned in the present game. Other arrangements of the hierarchy are also possible, such as reversing the order to place the lowest number at the apex, alternating odd and even numbers in alternate rows or levels, etc. However, the above described placement of the highest number at the apex of the pyramid with other numbers in descending order, or placing a random number at the apex with others in descending order, are perhaps the most quickly understood of the various systems which might be used, and may be preferable to other systems.

Figure 4:
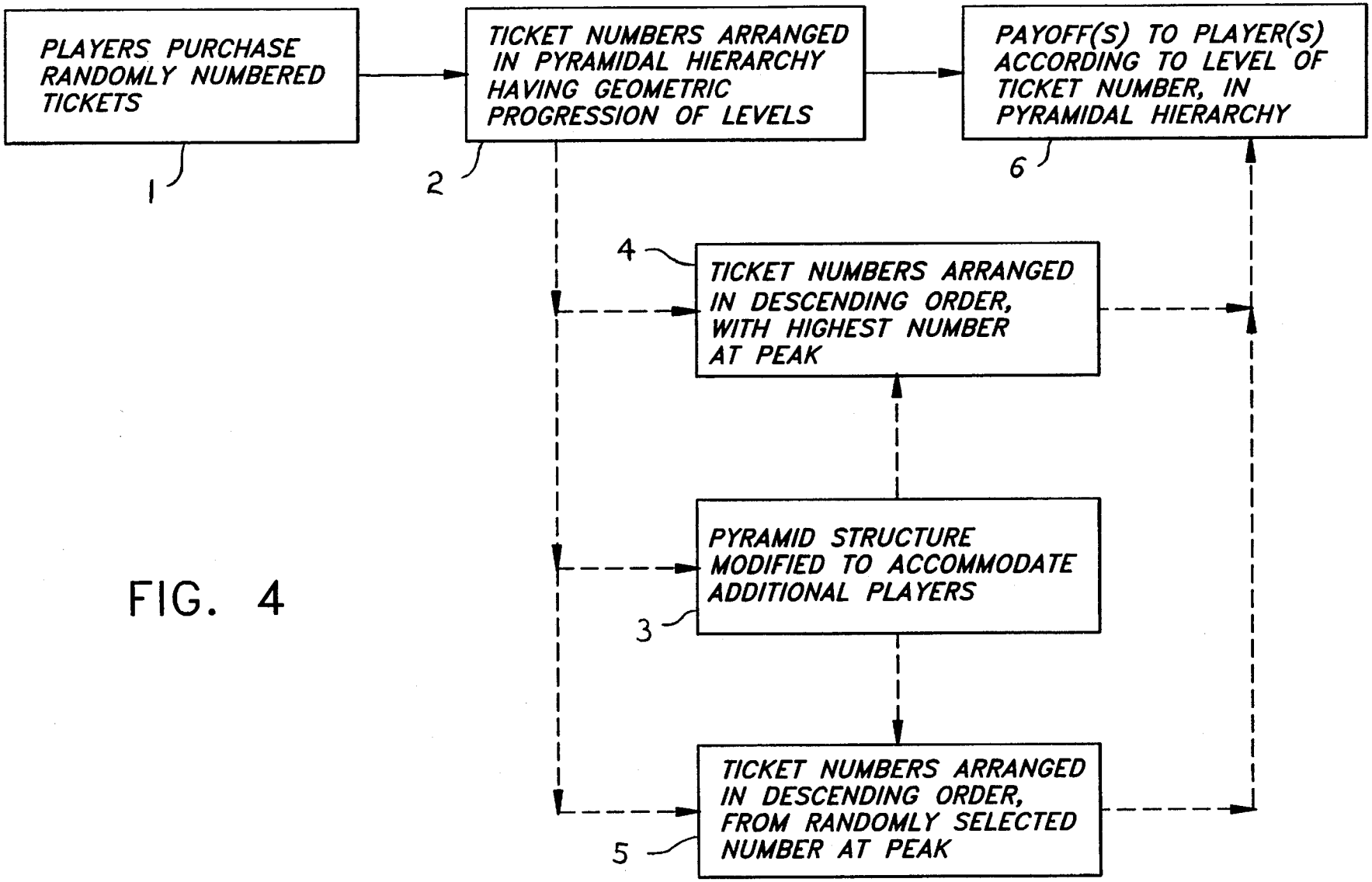
FIG. 4 is a flow chart or block diagram showing the general steps in the method of play of the present pyramid game.

FIG. 4 provides a block diagram or flow chart showing the general steps in the method of play of the present pyramid game, particularly when used as a lottery game. In such a lottery game, players purchase their randomly numbered tickets from an appropriate outlet, as indicated in step 1 of FIG. 4.

When entrance to the game is closed (as of a certain time, or due to a limit to the number of players, or other limit) the total number of tickets issued is used to form a pyramidal structure or configuration having a geometric progression of player positions for the levels based upon increasing exponential powers of two, in accordance with the rules for such described above and shown in FIG. 1. This is indicated generally as step 2 of FIG. 4.

In the event that the number of player positions for the game does not precisely fill the lowermost level of the pyramid, the remaining players may be redistributed to other levels to modify the pyramid structure to accommodate those players, according to the rules described above and shown generally in FIGS. 2A through 2E of the drawings. This is indicated by the optional step 3 of FIG. 4, as this step 3 may not be required in the event that the exact number of player positions required to exactly fill a classic geometric progression pyramid, occurs.

At this point, if not beforehand, one of the options for the arrangement of the player numbers in the pyramidal hierarchy of the player positions is determined. If a relatively simple and straightforward game is desired, the player numbers may be arranged as shown in FIG. 3, with the highest number placed in the apex or peak position and other numbers arranged in descending order in the levels below. This is indicated generally in step 4 of FIG. 4.

Alternatively, a number from the set may be randomly selected to fill the apex or peak position of the pyramid, with all other numbers below the randomly selected apex number being positioned in descending order therebelow and the remaining numbers placed in the remaining player positions in descending order. This is shown in FIG. 3B, and indicated generally in step 5 of FIG. 4. As noted above, other numerical arrangements are also feasible. (If a number is randomly selected from the set, which number is not one of those assigned to a player, then the player numbers will be arranged with the closest player number below the randomly selected number having the highest place in the hierarchical order.)

Once the distribution of the player numbers has been provided in the player positions of the pyramid, then it will be immediately evident to players whether or not they have won. Any player number having a position above the lowermost or base level is a winner, with higher levels providing greater awards or payoffs up to the apex or peak position, which provides the grand prize for the game. All player numbers in the base level lose, with no payoffs being awarded to those numbers in those positions. This is indicated generally in step 6 of FIG. 4.

In summary, the present pyramid game provides an interesting and enjoyable game, particularly for those persons interested in wagering games. The game lends itself well to large lottery games, as in state run games, and adapts well to the use of automated remote terminals or other ticket outlets for the purchase of tickets by players. Virtually any computer is readily adaptable for the calculation of the appropriate pyramid configuration depending upon the number of players involved. The mathematical arrangement of the pyramid structure discussed above may be easily calculated by computer in a fraction of a second, as ticket sales from remote sites are registered. The pyramid configuration also lends itself well to display via a video screen or terminal, whereupon players may readily see the location of the number which has been randomly assigned to them and instantly see if their number is located on a winning level. The ticket proceedings may be distributed as desired, preferably with the majority (e.g., 75%) being returned to winners of the game to encourage interest; differing percentages may be provided as desired. Thus, the present game will be seen to provide an excellent potential source of revenue for the governmental or other entity making use of it.

It is to be understood that the present invention is not limited to the sole embodiments described above, but encompasses any and all embodiments within the scope of the following claims.

I claim:

1. A method of playing a pyramid game, comprising the following steps:

(a) randomly assigning a series of integers to a plurality of players, with each player being assigned at least one integer and with no two integers being identical;

(b) providing a plurality of player positions directly corresponding to the integers assigned to the players;

(c) arranging the player positions in a pyramidal hierarchy, with the pyramidal hierarchy having a single player position and corresponding integer comprising a topmost level at the apex and a plurality of levels therebelow, with each lower level having a greater number of playing positions and corresponding integers therein than the next higher level, and;

(d) determining winning player positions and corresponding integers according to the relative positions of those player positions in the pyramidal hierarchy.

2. The method of playing a pyramid game of claim 1, including the step of:

determining the number of player positions in each level of the pyramidal hierarchy by using a geometric progression.

3. The method of playing a pyramid game of claim 2, including the step of:

determining the geometric progression using exponential powers of two, with the apex comprising a single player position defined by two to the zero power, the second level comprising two player positions defined by two to the first power, the third level comprising four player positions defined by two to the second power, the fourth level comprising eight player positions defined by two to the third power, and continuing in the same manner to provide a sufficient number of levels and player positions for all players.

4. The method of playing a pyramid game of claim 3, including the step of:

redistributing any number of player positions comprising less than a complete level, proportionally among other complete levels to accommodate all players.

5. The method of playing a pyramid game of claim 4, including the step of:

redistributing the number of player positions comprising the lowermost level, to form a lowermost level comprising no more than one half of the total player positions comprising the pyramidal hierarchy.

6. The method of playing a pyramid game of claim 1, including the step of:

providing equal awards to all player positions of a single level of the pyramidal hierarchy.

7. The method of playing a pyramid game of claim 6, including the steps of:

(a) providing greater awards to player positions of higher levels of the pyramidal hierarchy, and;

(b) providing the greatest award to the single player position comprising the apex level of the pyramidal hierarchy.

8. The method of playing a pyramid game of claim 7, including the step of:

providing no award to any player position of the lowermost level of the pyramidal hierarchy.

9. The method of playing a pyramid game of claim 1, including the steps of:

(a) numbering the player positions of the pyramidal hierarchy using the integers randomly assigned to the players of the game;

(b) assigning the highest integer to the single apex level, and;

(c) assigning all other integers to increasingly lower levels of the pyramidal hierarchy in descending numerical order.

10. The method of playing a pyramid game of claim 1, including the steps of:

(a) numbering the player positions of the pyramidal hierarchy using the integers randomly assigned to the players of the game;

(b) randomly selecting an integer from the integers randomly assigned to the players and assigning that randomly selected integer to the single apex level of the pyramidal hierarchy;

(c) assigning integers lower than the randomly selected integer to increasingly lower levels of the pyramidal hierarchy in descending numerical order, and;

(d) assigning integers higher than the randomly selected integer to the lowermost levels of the pyramidal hierarchy in descending numerical order and below the integers lower than the randomly selected integer.

11. A method of playing a wagering lottery game using a pyramidal hierarchy of numbered player positions, comprising the following steps:

(a) purchasing a plurality of randomly assigned integers by a plurality of players, with each player of the game being assigned at least one integer and with no two integers being identical;

(b) providing a plurality of player positions directly corresponding to the integers assigned to the players;

(c) arranging the player positions in a pyramidal hierarchy, with the pyramidal hierarchy having a single player position and corresponding integer comprising a topmost level at the apex and a plurality of levels therebelow, with each lower level having a greater number of playing positions and corresponding integers therein than the next higher level;

(d) determining winning player positions and corresponding integers according to the relative positions of those player positions in the pyramidal hierarchy, and;

(e) providing payoffs to players according to the winning player positions of the pyramidal hierarchy.

12. The method of playing a lottery game of claim 11, including the step of:

determining the number of player positions in each level of the pyramidal hierarchy by using a geometric progression.

13. The method of playing a lottery game of claim 12, including the step of:

determining the geometric progression using exponential powers of two, with the apex comprising a single player position defined by two to the zero power, the second level comprising two player positions defined by two to the first power, the third level comprising four player positions defined by two to the second power, the fourth level comprising eight player positions defined by two to the third power, and continuing in the same manner to provide a sufficient number of levels and player positions for all players.

14. The method of playing a lottery game of claim 13, including the step of:

redistributing any number of player positions comprising less than a complete level, proportionally among other complete levels to accommodate all players.

15. The method of playing a lottery game of claim 14, including the step of:

redistributing the number of player positions comprising the lowermost level, to form a lowermost level comprising no more than one half of the total player positions comprising the pyramidal hierarchy.

16. The method of playing a lottery game of claim 11, including the step of:

providing equal payoffs to all player positions of a single level of the pyramidal hierarchy.

17. The method of playing a lottery game of claim 16, including the steps of:

(a) providing greater payoffs to player positions of higher levels of the pyramidal hierarchy, and;

(b) providing the greatest payoff to the single player position comprising the apex level of the pyramidal hierarchy.

18. The method of playing a lottery game of claim 17, including the step of:

providing no payoff to any player position of the lowermost level of the pyramidal hierarchy.

19. The method of playing a lottery game of claim 11, including the steps of:

(a) numbering the player positions of the pyramidal hierarchy using the integers randomly assigned to the players of the game;

(b) assigning the highest integer to the single apex level, and;

(c) assigning all other integers to increasingly lower levels of the pyramidal hierarchy in descending numerical order.

20. The method of playing a lottery game of claim 11, including the steps of:

(a) numbering the player positions of the pyramidal hierarchy using the integers randomly assigned to the players of the game;

(b) randomly selecting an integer from the integers randomly assigned to the players and assigning that randomly selected integer to the single apex level of the pyramidal hierarchy;

(c) assigning integers lower than the randomly selected integer to increasingly lower levels of the pyramidal hierarchy in descending numerical order, and;

(d) assigning integers higher than the randomly selected integer to the lowermost levels of the pyramidal hierarchy in descending numerical order and below the integers lower than the randomly selected integer.

* * * * *